US006756950B1

(12) United States Patent
Tsai et al.

(10) Patent No.: US 6,756,950 B1
(45) Date of Patent: Jun. 29, 2004

(54) METHOD OF DRIVING PLASMA DISPLAY PANEL AND APPARATUS THEREOF

(75) Inventors: Andy T K Tsai, Hsinchu Hsien (TW); Lih Shang Lo, Taipei (TW)

(73) Assignee: Au Optronics Corp., Hsinchu (TW)

( * ) Notice: Subject to any disclaimer, the term of this patent is extended or adjusted under 35 U.S.C. 154(b) by 263 days.

(21) Appl. No.: 09/707,429

(22) Filed: Nov. 6, 2000

(30) Foreign Application Priority Data

Jan. 11, 2000 (TW) ..... 891009333 A

(51) Int. Cl.[7] ..... G09G 3/28
(52) U.S. Cl. ..... 345/60; 345/63; 345/68
(58) Field of Search ..... 345/60, 63, 66, 345/67, 68, 72

(56) References Cited

U.S. PATENT DOCUMENTS 4,180,762 A * 12/1979 Weber ..... 315/169.4
5,742,265 A * 4/1998 Stoller et al. ..... 345/60
5,745,086 A * 4/1998 Weber ..... 345/63
5,963,184 A * 10/1999 Tokunaga et al. ..... 345/60
6,002,381 A 12/1999 Tomio et al. ..... 345/60
6,034,482 A * 3/2000 Kanazawa et al. ..... 315/169.4
6,317,105 B1 * 11/2001 Eo et al. ..... 345/68

FOREIGN PATENT DOCUMENTS

EP 0 965 975 A1 12/1999

* cited by examiner

*Primary Examiner*—Dennis-Doon Chow
(74) *Attorney, Agent, or Firm*—Ladas & Parry

(57) ABSTRACT

A method of driving a plasma display panel is disclosed. According to this method, a global writing pulse is applied between the sustaining electrode X and the scan electrode Yi at a first time point of the reset period, so that wall charges of every cells in the plasma display panel are produced by the discharge between the sustaining electrode X and the scan electrode Yi. The global writing pulse includes a waveform having a large slope, which rises from the first voltage to the second voltage, and a waveform having a relatively small slope, which rises from the second voltage to the third voltage. Raising the voltage in a large slope can make the cells accumulate a large amount of wall charges, and raising the voltage in a small slope can avoid affecting the image quality by producing a high brightness.

18 Claims, 4 Drawing Sheets

METHOD OF DRIVING PLASMA DISPLAY PANEL AND APPARATUS THEREOF

BACKGROUND OF THE INVENTION

1. Field of the Invention

This invention relates to a method of driving a plasma display panel (hereinafter referred to as PDP) and its apparatus. The method and apparatus of the present invention can reduce the backglow phenomena caused by the discharge operation during the reset period for PDP.

2. Description of Prior Art

The PDP displays images by means of charges accumulated through electrode discharge. It is one of the most interesting plate display devices because, among other advantages, it can provide a large screen aspect ratio and can display full-color images. The basic theory and operation of a PDP is described below.

FIG. 1 is a cross-sectional view of a conventional PDP cell constructed by two glass substrates 1 and 7 and the components formed thereon. Inactive gas, such as Ne, Xe, is filled in the cavity between the glass substrates 1 and 7. The components formed on the glass substrate 1 include sustaining electrodes X, scan electrodes Yi which are parallel to each other, a dielectric layer 3 and a protective film 5. The components formed on the glass substrate 7 include address electrodes Ai and the fluorescent material 9 formed thereon. The partition wall 8 is formed on the peripheral of each PDP cell to isolate the PDP cell. Therefore, each PDP cell 10 includes three kinds of electrodes, i.e., the sustaining electrodes and the scan electrodes which are parallel to each other, and the address electrodes Ai crossing the sustaining electrodes and the scan electrodes.

FIG. 2 is a block diagram illustrating a plasma display formed by the PDP cells shown in FIG. 1. As shown in the drawing, the PDP 100 is driven by the scan electrodes Y1~Yn, the sustaining electrodes X and the address electrodes A1~Am. The position of the cell 10 is as shown in the drawing. Each, cell is isolated by the partition wall 8 as shown in FIG. 1. Furthermore, the plasma display includes the control circuit 110, the Y scan driver 112, the X sustaining driver 114 and the address driver 116. The control circuit 110 generates timing signals for the drivers according to the external clock signal CLOCK, the data signal DATA, the vertical synchronous signal VSYNC and the horizontal synchronous signal HSYNC, wherein the clock signal CLOCK represents the data transmittal clock, the data signal DATA represents the display data, and the vertical synchronous signal VSYNC and the horizontal synchronous signal HSYNC are respectively used to define the timing sequences of a frame and a scanning line. The control circuit 110 sends the display data and the clock signal to the address driver 116 and sends the corresponding frame control clock to the Y scan driver 112 and the sustaining driver 114. The display data is transmitted to the address driver 116 by the control circuit 110 and is written to each cell through the address electrodes A1~Am while the Y scan driver 112 sequentially scans the scan electrodes Y1~Yn. The detailed operation and the control signals for the electrodes are described below.

FIG. 3 is a diagram illustrating the manner to drive a conventional PDP to display a frame. As shown in the drawing, each frame is divided into eight sub-fields SF1~SF8. However, the sub-field is different to the field of a conventional cathode ray tube (CRT), which displays an image by respectively scanning the odd scanning lines and the even scanning lines. The PDP field displays various gray scales for all of the scanning lines. Each sub-field includes three operating period, that is, the reset period R1~R8, the address period A1~A8 and the sustain period S1~S8. The reset period is used to clear the residual charges of the last field display and a certain amount of the wall charges left in each cell. The address period is used to accumulate wall charges into the cell, which is to be displayed (i.e., turned ON), through address discharge. The sustain period is to sustain discharge for displaying in the cell which has accumulated charges through the address discharge. All of the PDP cells are processed at the same time during the reset period R1~R8 and the sustain period S1~S8. The address operation is sequentially performed for each cell on the scan electrodes Y1~Yn during the address period A1~A8. Moreover, the display brightness is proportional to the length of the sustain period S1~S8. In the example of FIG. 3, the length of the sustain periods S1~S8 of the sub-fields SF1~SF8 can be set in a ratio of 1:2:4:8:16:32:64:128 to display images in 256 gray scales.

FIG. 4 is a timing diagram of the control signals on the electrodes in a single sub-field of the prior art. The signals on the address electrodes Ai are generated by the address driver 116, the signals on the sustaining electrodes X are generated by the X sustaining driver 114, and the signals on the scan electrodes Y1~Yn are generated by the scan driver 112. As shown in the drawing, each sub-field includes the reset period, the address period and the sustain period. The waveform of the signals in each period and the resulted manners are described in detail below.

At the time point a (in FIG. 4) of the reset period, the voltage of the scan electrodes Y1~Yn is set to 0 V, and a write pulse having a voltage of VS+VW is applied to the sustaining electrode X, in which the voltage VS+VW is larger than the discharge start voltage between the sustaining electrode X and the scan electrode Yi. Therefore, the global writing discharge W occurs between the sustaining electrode X and the scan electrodes Yi. This discharge process accumulates negative charges on the sustaining electrode X and positive charges on the scan electrodes Yi. The electric field produced by the accumulated negative charges and the positive charges will cancel out the voltage drop between the sustaining electrodes, thus the time of global writing discharge W is very short.

At the time point b, the sustaining electrode X is set to 0 V, and a sustaining pulse 202 having a voltage of $V_s$ is applied to all of the scan electrodes Y1~Yn, wherein the value of the voltage $V_s$ plus the voltage caused by the charges accumulated between the sustaining electrodes must be larger than the discharge start voltage between the scan electrodes Yi and the sustaining electrode X. Thus, the total sustaining discharge S occurs between the sustaining electrode X and the scan electrodes Yi. Different from the previous discharge process, this discharge process accumulates positive charges on the sustaining electrode X and negative charges on the scan electrodes Yi.

At the time point c, the scan electrode Yi is set to 0 V, an erase pulse 203 having a voltage lower than $V_s$ is applied to the sustaining electrode X, and an address pulse having a voltage of $-V_s$ can be applied to the address electrode Ai. The erase pulse is used to neutralize a part of the charges. On the scan electrodes Y1~Yn, required wall charges are left so that the write operation can proceed with a lower voltage in the sequential address period.

In the address period, the voltage of the sustaining electrode X and the scan electrodes Yi are pulled up to $V_s$ at the time point d. Then a scan pulse 204 is sequentially applied to the scan electrodes Y1~Yn from the time point e, and an address pulse having a voltage of $V_A$ is applied to the address electrode Ai at the same time. When a cell of a scanning line turns ON, the write discharge occurs, that is, the corresponding display data is written into the cell.

After scanning all of the scan electrodes Y1~Yn, the sustain period begins. The sustaining electrode X and the scan electrode Yi are first set to 0 V. Then the sustaining pulses 205 having the same voltage are applied to the sustaining electrode X and the scan electrodes Yi in an alternate way, i.e., at the time point f and at the time point g. Thus, the cell with the data ON during the address period will irradiate. It should be noted that the waveform of driving signals described above is only an example. The waveform varies in practice, but the same theory is applied.

As described above, the length of the sustain period is proportional to the displayed brightness. Assume that a frame includes 510 sustain periods, in which each sustaining discharge period has two periods of discharge. The number of sustain periods for the sub-fields SF1~SF8 can be 2, 4, 8, 16, 32, 64, 128, and 256, respectively. Therefore, there are 1020 periods of discharge of the sustain period during the display period of a frame. This discharge operation enables a PDP device to display images.

On the other hand, 2 to 3 discharges, such as global writing discharge, total sustaining discharge and erase discharge, are performed during the reset period to uniformly distribute the wall charges. The discharges during the reset period can also make the PDP device irradiate with a brightness brighter than that produced by the discharge during the sustain period. Roughly speaking, the brightness produced by three periods of discharge during the reset period is about the brightness by five periods of discharge during the sustain period. The ratio of the highest brightness and the lowest brightness for the PDP device is about 1020:(5×8) =26:1, in which 1 corresponds to the brightness of black. Therefore, the brightness produced by the discharge during the reset period should be as low as possible in order to improve the image quality of black, which is an important factor for displaying images. It is thus a significant issue to reduce the brightness produced by the discharge during the reset period.

SUMMARY OF THE INVENTION

Accordingly, the object of this invention is to provide an apparatus for driving a PDP, which includes: a control circuit for receiving the external displaying data and the relevant timing data; an address driver, connected to the control circuit, for driving the address electrodes; an X driver, connected to the control circuit, for driving the sustaining electrodes, wherein a global writing pulse is applied to the sustaining electrodes during the reset period to produce the wall charges for the cells of the PDP through the discharge between the sustaining electrodes and scan electrodes; and a Y scan driver, connected to the control circuit, for driving the scan electrodes. The global writing pulse has a waveform rising up from a first voltage to a second voltage with a large slope, then rising up from the second voltage to a third voltage with a relatively small slope or a waveform rising up from a first voltage to a second voltage with a small slope, then rising up from the second voltage to a third voltage with a relatively large slope.

Moreover, this invention provides an apparatus for driving a PDP. The X driver applies the first component of the global writing pulse to the sustaining electrodes during the reset period. The first component of the global writing pulse has a waveform rising up from the first voltage to the second voltage with a large slope. The Y scan driver applies the second component of the global writing pulse to the scan electrodes during the reset period. The second component of the global writing pulse has a waveform falling down to the second voltage with a small slope. The wall charge on the cells of the PDP is produced through the discharge caused by the global writing pulse between the sustaining electrodes and the scan electrodes.

BRIEF DESCRIPTION OF THE DRAWINGS

The following detailed description, given by way of example and not intended to limit the invention solely to the embodiments described herein, will best be understood in conjunction with the accompanying drawings in which.

DETAILED DESCRIPTION OF THE PREFERRED EMBODIMENTS

This invention provides a novel method of driving a plasma display panel and its apparatus. According to the present invention, a global writing pulse is applied between the sustaining electrode X and the scan electrode Yi at a first time point of the reset period, so that wall charges of every cells in the plasma display panel are produced by the discharge between the sustaining electrode X and the scan electrode Yi. The global writing pulse includes a waveform having a large slope, which rises from the first voltage to the second voltage, and a waveform having a relatively small slope, which rises from the second voltage to the third voltage. Raising the voltage in a large slope can make the cells accumulate a large amount of wall charges, and raising the voltage in a small slope can avoid affecting the image quality by producing a high brightness. The invention is further described by means of the following embodiments.

First Embodiment

Figure 1:
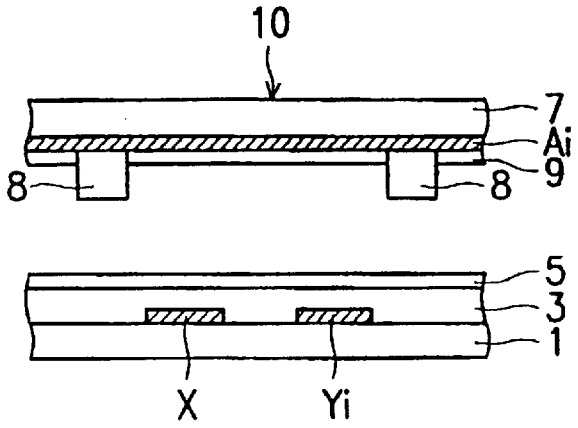
Fig. 1 (PRIOR ART)
FIG. 1 is a cross-sectional view of a cell of a conventional PDP.
Figure 2:
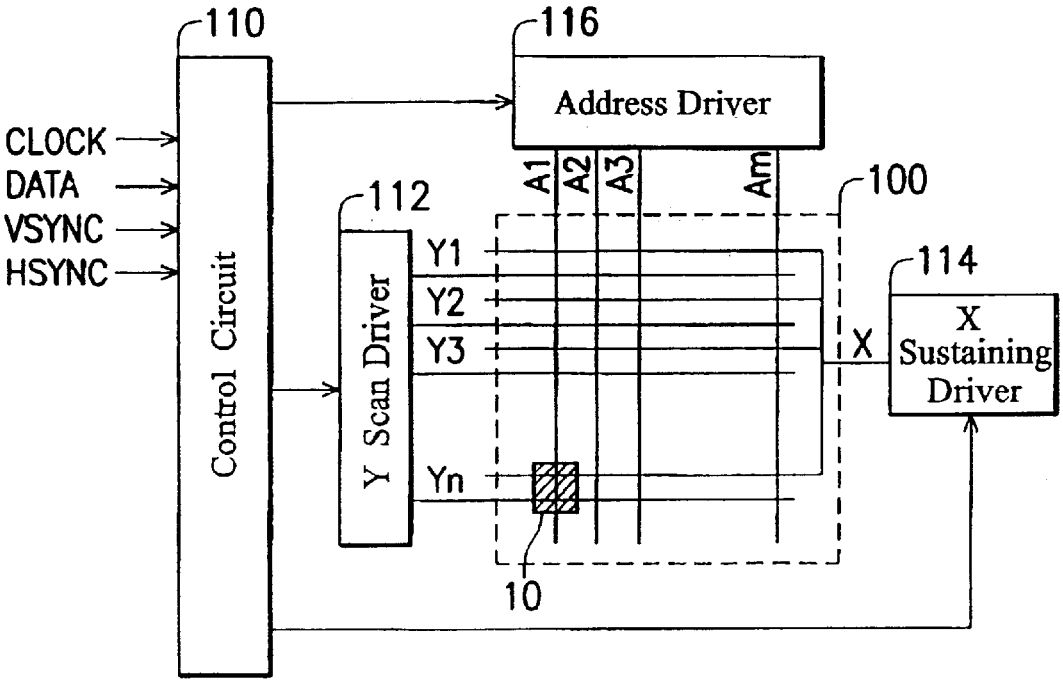
Fig. 2 (PRIOR ART)
FIG. 2 is a block diagram of a display device constituted by the PDP shown in FIG. 1.
Figure 3:
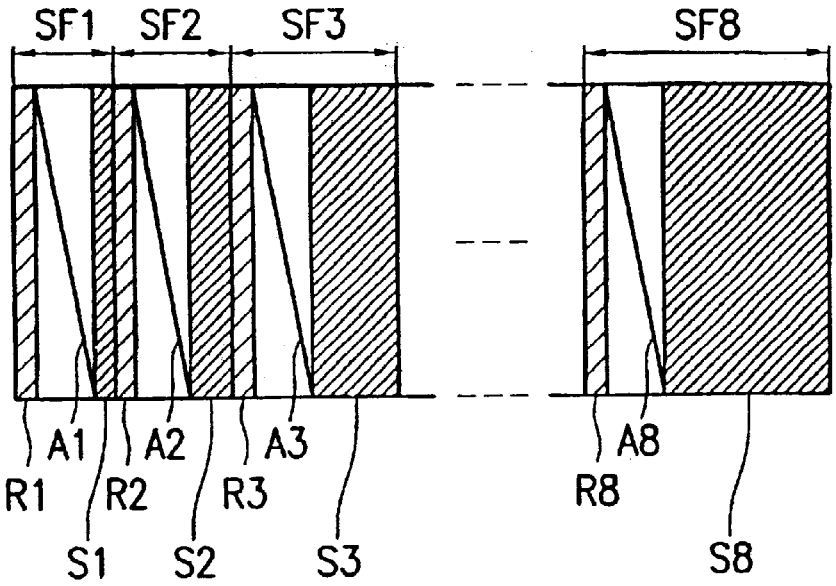
Fig. 3 (PRIOR ART)
FIG. 3 is a diagram illustrating a PDP driven to display a frame according to the prior arts.
Figure 4:
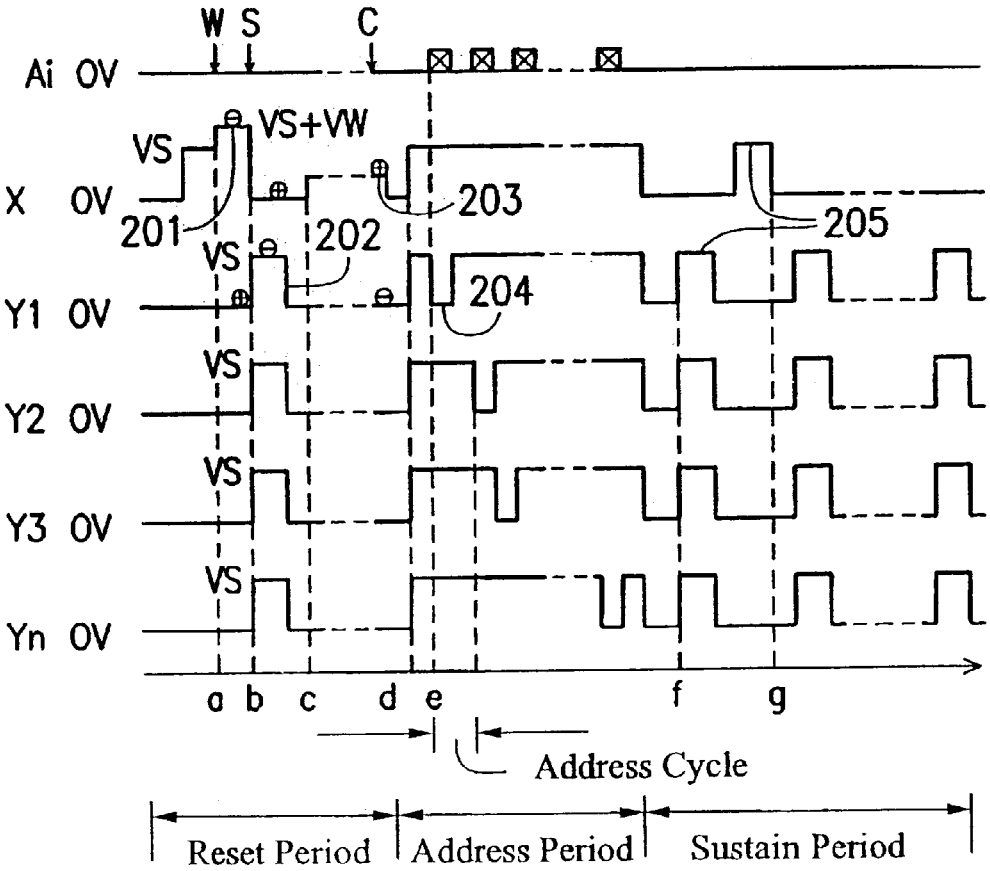
Fig. 4 (PRIOR ART)
FIG. 4 is a timing diagram of the control signals for the electrodes including the address electrodes Ai, the sustaining electrodes X and the scan electrodes Yi in a single sub-field according to the prior arts.
Figure 5:
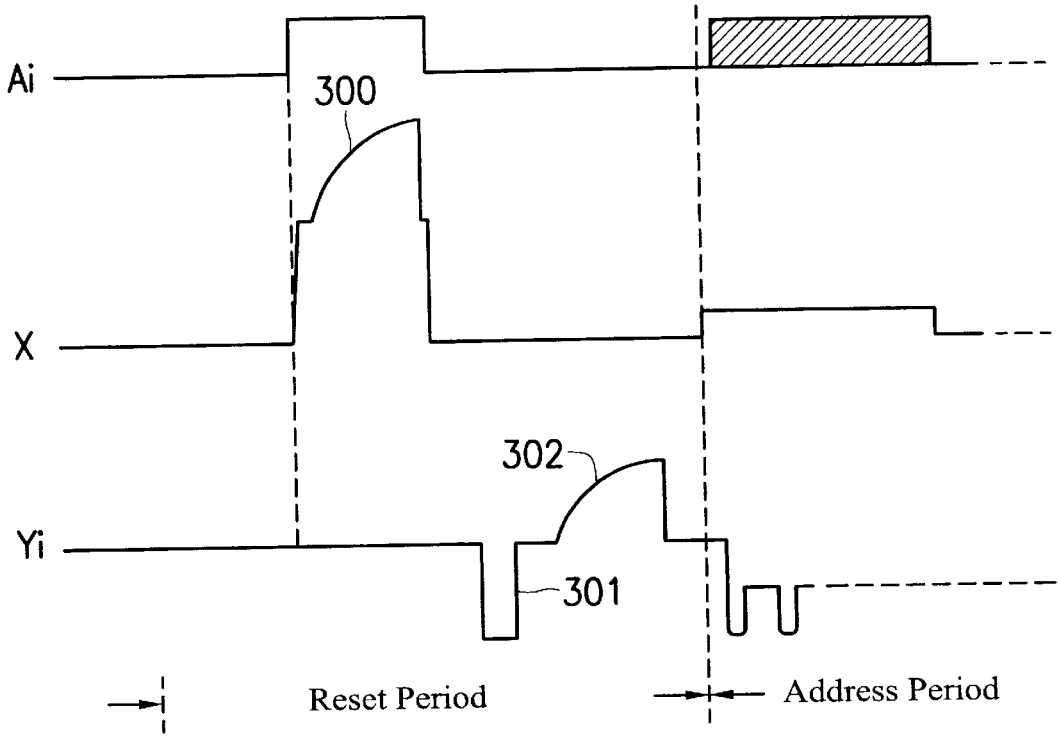
FIG. 5 is a timing diagram of the control signals for the electrodes including the address electrodes Ai, the sustaining electrodes X and the scan electrodes Yi in the reset period of a sub-field according to the first embodiment of this invention.

FIG. 5 is a timing diagram of the control signals on the electrodes including the address electrodes Ai, the sustaining electrodes X and the scan electrodes Yi during the reset period of a sub-field in this embodiment. The cells of all scan lines are processed during the reset period to produce a certain amount of wall charges. The scan electrodes Yi referred to hereinafter indicate all of the scan electrodes Y. An erase pulse is applied to the scan electrode Yi to erase the wall charges in the cells which are turned on in the sub-field before the sub-field is finished. As shown in FIG. 5, a global writing pulse 300 is applied to the sustaining electrodes X at a time point of the reset period of the sub-field to maintain the voltage difference between the sustaining electrodes X and the scan electrodes Yi to be larger than the initial voltage for the discharge between the sustaining electrodes X and the scan electrodes Yi, so as to generate the wall charges by discharge. The global writing pulse 300, which has a waveform including two parts, is different to that disclosed in the prior arts. The global writing pulse 300 includes a waveform having a large slope which rises from the first voltage (0 V) to the second voltage and a waveform having a relatively small slope which rises from the second voltage to the third voltage. In this embodiment, the second voltage can be set to 180 V and the third voltage can be set to 360 V. The erase pulse 301 and the erase pulse 302 are applied to the scan electrodes Yi sequentially. Thereafter, the process proceeds to the address period and the sustain period. It should be noted that this invention is not limited to the configuration of the control signals for the electrodes during the reset period in this embodiment. Various modifications can be made by those who skilled in the relevant art of driving a PDP.

The primary characteristic of this invention is the waveform of the global writing pulse 300. The detailed description is given below. The first part of the global writing pulse 300 is a waveform having a large slope which rises from the first voltage (0 V) to the second voltage. The effect of this part is to accumulate a large amount of wall charges. The second part of the global writing pulse 300 is a waveform having a relatively small slope which rises from the second voltage to the third voltage. The effect of this part is also to accumulate the wall charges. However, since the voltage rising slope is small, the discharge effect is reduced. Thus, the brightness of the PDP is also reduced. In other words, the use of the global writing pulse 300 can make the PDP device accumulate a large amount of wall charges and not cause the backglow.

Figure 6:
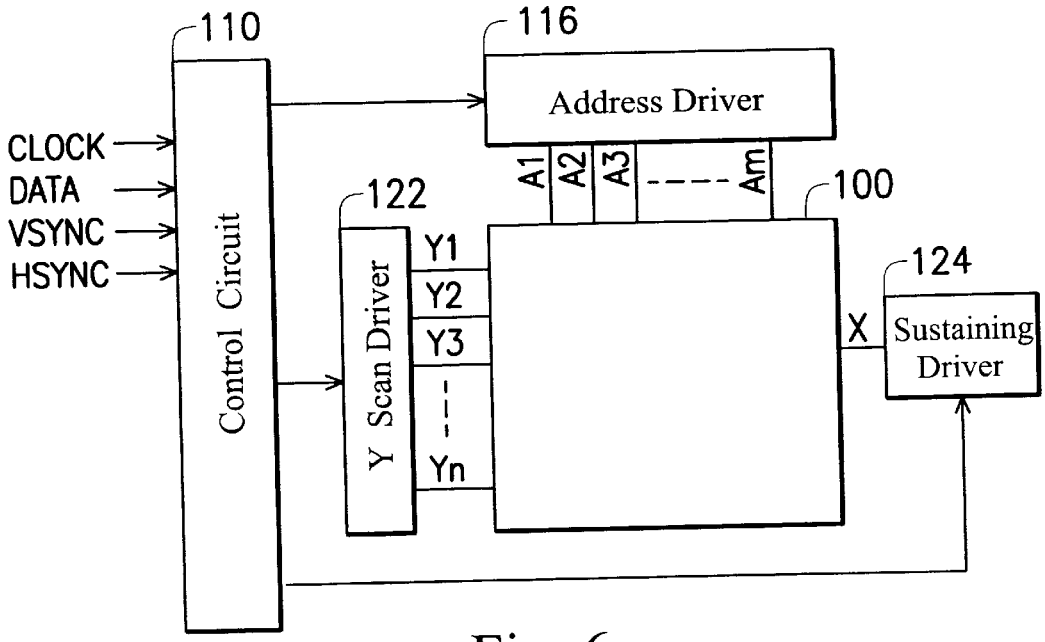
FIG. 6 is a block diagram of the driving device of the PDP according to the first embodiment of this invention.

FIG. 6 is a block diagram of the driving apparatus of the PDP device in this embodiment The driving apparatus includes a control circuit 110, an address driver 116, a sustaining driver 124 and a scan driver 122. The control circuit 110, receives the display data DATA, the transmission clock CLOCK, the vertical synchronous signal VSYNC and the horizontal synchronous signal HSYNC from the exterior, and transmits the above data and signals to the drivers. The address driver 116 drives the address electrodes Ai during the address period to write the display data in the cells of every scan lines. The scan driver 122 is used to drive the scan electrodes Yi. The sustaining driver 124 is used to drive the sustaining electrodes X.

As shown in FIG. 5, the global writing pulse applied by the sustaining electrodes 124 during the reset period of every sub-field includes a waveform having a large slope which rises from the first voltage (0 V) to the second voltage (180 V), and a waveform having a relatively small slope which rises from the second voltages (180 V) to the third voltage (360 V). The wall charges of each cell are generated by the discharge between the sustaining electrode X and the scan electrode Yi in each cell.

Moreover, the waveform of the global writing pulse 300 shown in FIG. 5 is similar to a secondary curve which has a shape protruded outward. The sustaining driver 124 can generate such a waveform by using the step voltages to synthesize and approach the waveform.

In other words, as shown in FIG. 5, the driving method comprising the sequential steps of:

(1) applying the first rising waveform (the vertical rising portion of pulse 300) with the first slope to the sustaining electrode X to make the voltage between the sustaining electrode X and the scan electrode Y rise from the first voltage (0 V) to the second voltage (180 V);

(2) applying the second rising waveform (the curve portions of pulse 300) with a second slope to the sustaining electrode X to make the voltage between the sustaining electrode X and the scan electrode Y rise from the second voltage (180 V) to the third voltage (360 V), so as to accumulate wall charges between the sustaining electrode X and the scan electrode Y;

(3) applying the falling waveform (the falling portion of pulse 300) to the sustaining electrode X to make the voltage between the sustaining electrode X and the scan electrode Y return to the first voltage (0 V) from the third voltage (360 V);

(4) applying the first erase pulse 301 to the scan electrode Y;

(5) applying the second erase pulse 302 with the polarity opposite to that of the first erase pulse 301 to the scan electrode Y to erase the wall charge. The second slope is much smaller than the first slope for reducing the discharge effect between the sustaining electrode and the scan electrode when accumulating the wall charge.

According to the description above, the PDP driving method of this embodiment is to modify the global writing pulse in the reset period to make the PDP cells be able to accumulate a large amount of charges and not affect the image quality by having a high brightness while discharging. It is only necessary to modify a part of the circuit of the X driver to produce the waveform of the global writing pulse. Therefore, the cost is only a little higher than that of a conventional PDP driver.

Second Embodiment

The basic driving method and the driving apparatus of this embodiment is the same as the first embodiment except for the waveform of the global writing pulse 300. In the first embodiment, the global writing pulse 300 includes the first part, which is a waveform having a large slope rising from the first voltage to the second voltage, and the second part, which is a waveform having a relatively small slope rising from the second voltage to the third voltage. The slope in the second part is gradually increased. A variety of different waveforms that can achieve the object of this invention are given in this embodiment to explain the difference.

Figure 7A:
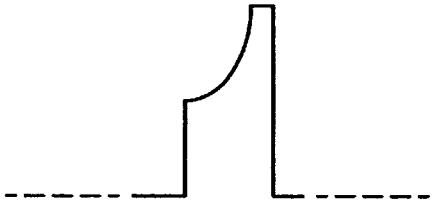
FIGS. 7*a* and 7*b* are diagrams illustrating the waveforms of the global writing pulse according to the second embodiment of this invention.

FIG. 7*a* illustrates a first waveform of the global writing pulse 300 in this embodiment. As shown in the drawing, the global writing pulse 300 has a first part having a large slope which rises from the first voltage to the second voltage and a second part having a relatively small slope which rises from the second voltage to the third voltage. The difference of this embodiment from the first embodiment is that the slope in the second part is gradually increased, thus the secondary curve is inwardly concave. Using such a global writing pulse 300 can also accumulate a large amount of charges and avoid affecting the image quality by producing a high brightness while discharging.

Figure 7B:
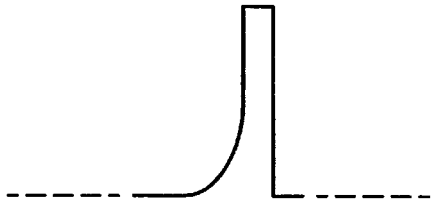

FIG. 7*b* illustrates a second waveform of the global writing pulse 300 in this embodiment. The difference of this embodiment to the first embodiment is that the global writing pulse 300 has a first part rising in a small slope and a second part rising in a relatively large slope which is almost vertical. Therefore, the waveform is like a secondary curve which is inwardly concave. Using such a global writing pulse 300 can also accumulate a large amount of charges and avoid affecting the image quality by producing a high brightness while discharging.

According to the description above, this invention is not limited to a certain waveform of the global writing pulse, and can be accomplished by raising the voltage in two steps.

Third Embodiment

This embodiment provides a waveform which is equivalent to that of the global writing pulse of the first embodiment. Referring to FIG. 5, the global writing pulse 300 on the sustaining electrodes X is synthesized by two parts. Thus, the circuit of the sustaining driver 124 used to produce this waveform is complicated and costly. In this embodiment, the two parts of the global writing pulse 300 are respectively produced by the sustaining driver 124 and the scan driver 122 and applied to the sustaining electrodes X and the scan electrodes Yi so as to simplify the waveform-producing circuit.

Figure 8:
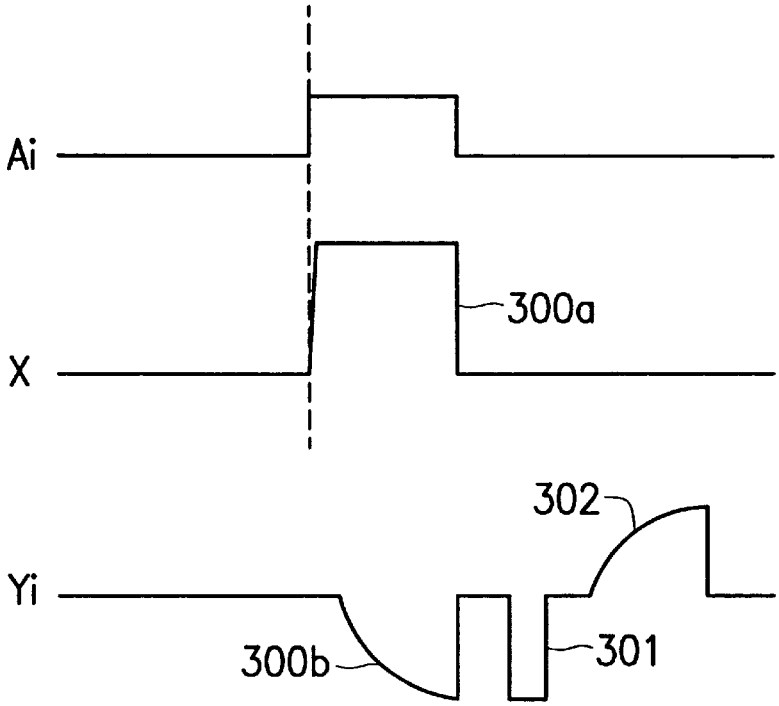
FIG. 8 is a timing diagram of the control signals for the electrodes including the address electrodes Ai, the sustaining electrodes X and the scan electrodes Yi in the reset period of a sub-field according to the third embodiment of this invention.

FIG. 8 is a diagram illustrating the timing of the control signals on the address electrodes Ai, the sustaining electrodes X and the scan electrodes Yi during the reset period of the sub-field in this embodiment. As shown in the drawing, the global writing pulse 300 is obtained by synthesizing the first pulse component 300*a*, which quickly rises from the first voltage to the second voltage, on the sustaining electrodes X and the second pulse component 300*b*, which slowly falls from the third voltage to the fourth voltage, on the scan electrodes Yi. The discharge effect of this synthesized waveform is the same as obtained in the first embodiment. The first pulse component 300*a* is the same as the waveform having a large slope of the global writing pulse 300. The second pulse component 300*b* is the same as the waveform having a relatively small slope of the global writing pulse 300. However, in terms of the circuit fabrication, it is easier to produce the waveform of FIG. 8 than to produce the waveform of FIG. 5. To produce the waveform of FIG. 8, it is not necessary for the sustaining driver 124 to use a voltage-duplicate circuit, but only to add some basic elements to the scan driver 122.

Further, the present invention is not limited to the above-described embodiment, and variations and modifications may be made without departing from the scope of the present invention.

What is claimed is:

1. A method for driving a plasma display panel which includes a sustaining electrode and a scan electrode, an address electrode crossing over the sustaining electrode and the scan electrode, comprising the step of applying a global writing pulse formed by a voltage difference between the sustaining electrode and the scan electrode at a first time point of a reset period, the global writing pulse including an antecedently first-level raising waveform having a first period and raised from a first-voltage level to a second-voltage level with a large first waveform slope, and a subsequent second-level raising waveform having the same polarity as the antecedently first-level raising waveform, having a second period longer than the first period and raising from the second-voltage level to a third-voltage level with a relatively small second waveform slope, wherein a discontinuous separation point is formed between the large first waveform slope and the small second waveform slope, and wherein the voltage level of the waveform of the global writing pulse lower than the second-voltage level produces more wall charges than the voltage level of the waveform of the global writing pulse higher than the second-voltage level and the voltage level of the waveform of the global writing pulse higher than the second-voltage level decreases brightness of the plasma display panel more than the voltage level of the waveform of the global writing pulse lower than the second-voltage level.

2. The driving method as claimed in claim 1, wherein the second-voltage level is 180 V.

3. The driving method as claimed in claim 1, wherein the third-voltage level is 360 V.

4. The driving method as claimed in claim 1, wherein the large first waveform slope and the small second waveform slope are positive.

5. The driving method as claimed in claim 1, wherein the subsequent second-level raising waveform is a curve having a decreasing positive slope.

6. The driving method as claimed in claim 1, further comprising the steps of applying a first erase pulse to the sustaining electrode and the scan electrode after the first time point of the reset period to erase the redundant wall charges and applying a second erase pulse, which has a polarization opposite that of the first erase pulse, to the sustaining electrode and the scan electrode to erase ions generated by the discharge.

7. The driving method as claimed in claim 1, wherein the global writing pulse is applied to the sustaining electrode and a fixed voltage is maintained on the scan electrode.

8. A method for driving a plasma display panel which includes a sustaining electrode and a scan electrode, an address electrode crossing over the sustaining electrode and the scan electrode, comprising the step of applying a global writing pulse formed by a voltage difference between the sustaining electrode and the scan electrode at a first time point of a reset period, the global writing pulse including an antecedently first-level raising waveform having a first period and a large first waveform slope, and a subsequent second-level raising waveform having the same polarity as the antecedently first-level raising waveform and having a second period longer than the first period and a relatively small second waveform slope, wherein the levels of the second-level raising waveform all exceeds the levels of the first-level raising waveform, and a discontinuous separation point is formed between the large first waveform slope and the small second waveform slope, and wherein the antecedently first-level raising waveform produces more wall charges than the subsequent second-level raising waveform and the subsequent second-level raising waveform decreases brightness of the plasma display panel more than the antecedently first-level raising waveform.

9. The driving method as claimed in claim 8, wherein the voltage level of the discontinuous separation point is 180 V.

10. The driving method as claimed in claim 8, wherein the large first waveform slope and the small second waveform slope are positive.

11. The driving method as claimed in claim 8, wherein the subsequent second-level raising waveform is a curve having a decreasing positive slope.

12. The driving method as claimed in claim 8, further comprising the steps of applying a first erase pulse to the sustaining electrode and the scan electrode after the first time point of the reset period to erase the redundant wall charges and applying a second erase pulse, which has a polarization opposite that of the first erase pulse, to the sustaining electrode and the scan electrode to erase ions generated by the discharge.

13. The driving method as claimed in claim 8, wherein the global writing pulse is applied to the sustaining electrode and a fixed voltage is maintained on the scan electrode.

14. A driving apparatus for a plasma display panel which includes a sustaining electrode, a scan electrode and an address electrode crossing the sustaining electrode and the scan electrode, the driving apparatus comprising:

a control circuit for receiving external display data and relevant clock data;

an address driver, connected to the control circuit, for driving the address electrode;

a sustaining driver, connected to the control circuit, for driving the sustaining electrode, wherein a global writing pulse formed by a voltage difference between the sustaining electrode and the scan electrode is applied at a first time point of a reset period, the global writing pulse includes an antecedently first-level raising waveform having a first period and raising from a first-voltage level to a second-voltage level with a large first waveform slope, and a subsequent second-level raising waveform having the same polarity as the antecedently first-level raising waveform, having a second period longer than the first period and raising from the second-voltage level to a third-voltage level with a relatively small second waveform slope, wherein a discontinuous separation point is formed between the large first waveform slope and the small second waveform slope, and wherein the voltage level of the waveform of the global writing pulse lower than the second-voltage level produces more wall charges than the voltage level of the waveform of the global writing pulse higher than the second-voltage level and the voltage level of the waveform of the global writing pulse higher than the second-voltage level decreases brightness of the plasma display panel more than the voltage level of the waveform of the global writing pulse lower than the second-voltage level; and a scan driver, connected to the control circuit, for driving the scan electrode.

15. The driving apparatus as claimed in claim 14, wherein the second-voltage level is 180 V.

16. The driving apparatus as claimed in claim 14, wherein the third-voltage level is 360 V.

17. The driving apparatus as claimed in claim 14, wherein the large first waveform slope and the small second waveform slope are positive.

18. The driving apparatus as claimed in claim 14, wherein the subsequent second-level raising waveform is a curve having a decreasing positive slope.

* * * * *